United States Patent [19]

Herz

[11] 4,244,453

[45] Jan. 13, 1981

[54] GARMENT COVER, HANGER AND CARRIER WITH REMOVABLE CONTAINER FOR ACCESSORIES, ETC.

[76] Inventor: Kurt P. Herz, 12-11 43rd Ave., Long Island City, N.Y. 11101

[21] Appl. No.: 87,690

[22] Filed: Oct. 22, 1979

[51] Int. Cl.[3] ..... A45C 5/00

[52] U.S. Cl. ..... 190/43; 206/287; 206/289

[58] Field of Search ..... 190/41 B, 43; 206/287, 206/289

[56] References Cited

U.S. PATENT DOCUMENTS

| | | | |
|---|---|---|---|
| 1,651,706 | 12/1927 | Holbrook | 206/289 X |
| 3,034,552 | 5/1962 | Herz | 206/287 X |
| 3,244,261 | 4/1966 | Herz | 206/287 X |
| 3,299,997 | 1/1967 | Herz | 206/289 X |
| 3,929,224 | 12/1975 | Smith | 206/287 |

*Primary Examiner*—Donald F. Norton

[57] ABSTRACT

A garment cover, hanger, carrier, and removable accessory container encloses suits, coats, capes, dresses, and other lengthy wearing apparel in a protecting bag or container which is generally of the type comprising rectangular sacks of proper length to accommodate a given number of articles to be housed upon coat or garment hangers arranged therein, which possesses suspension hooks extending therefrom in order that they may be hung or suspended from a convenient support; the apparatus of the invention comprising an interiorly disposed but readily removable container for accessories, such as neckties, etc. which is supported by the horizontal cross-bar of one of the aforementioned hangers.

3 Claims, 3 Drawing Figures

Figure 1:
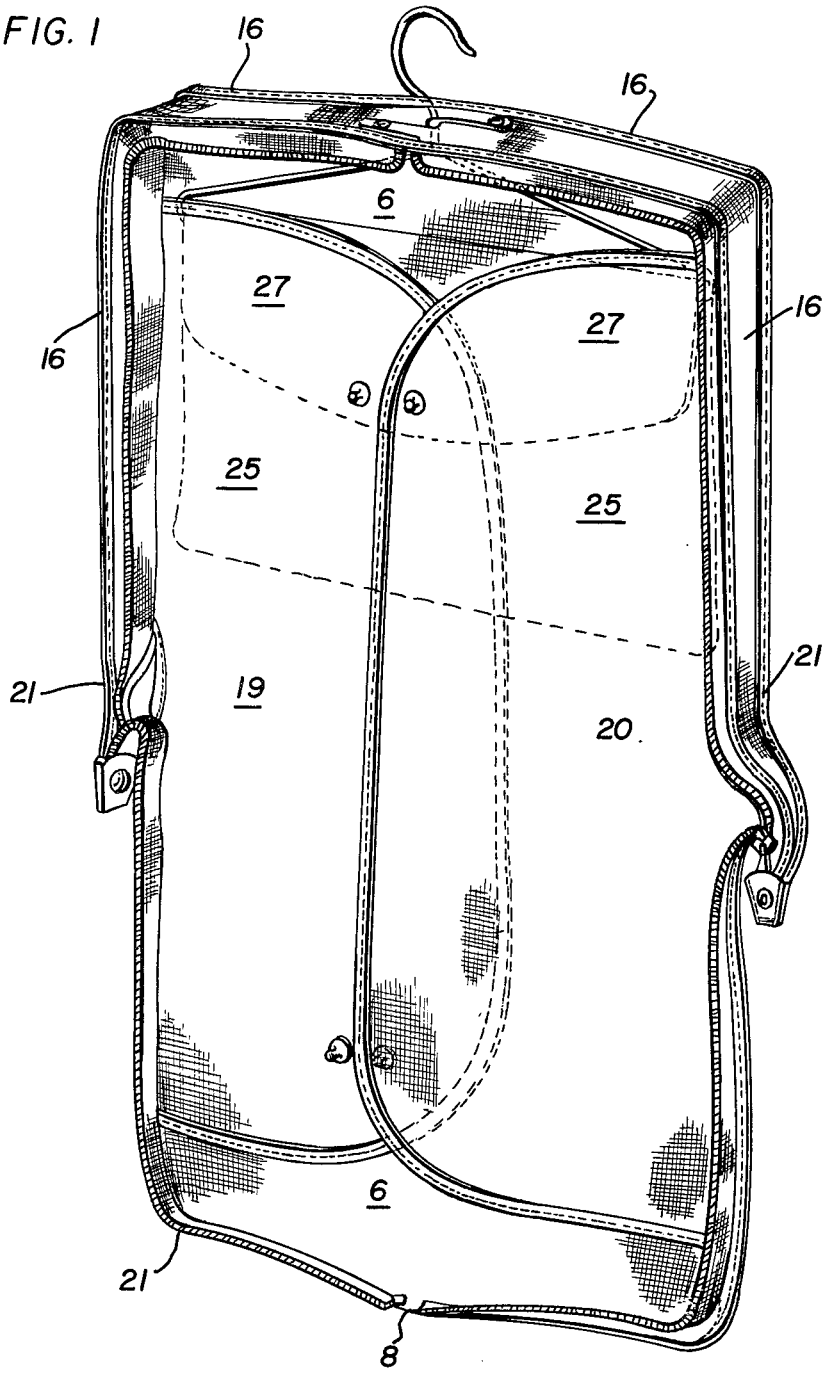

GARMENT COVER, HANGER AND CARRIER WITH REMOVABLE CONTAINER FOR ACCESSORIES, ETC.

The present invention relates to a garment cover, hanger, and carrier which entirely encloses the garments in full-length or unfolded condition and provided with means whereby the apparatus may be supported from above while fully extended from a suitable support, the same being of the same general type as those which are disclosed in my following prior United States Patents:

| Patent No. | Issued | Title |
|---|---|---|
| 3,034,552 | May 15, 1962 | Garment Cover |
| 3,244,261 | Apr. 5, 1966 | Garment Carrier and Hanger |
| 3,299,997 | Jan. 24, 1967 | Case and Garment Carrier |

It is among the objects of the present invention to provide an apparatus of the type generally represented by the aforementioned patents, and which is flexible and foldable along a transverse center-line in the manner of my aforementioned U.S. Pat. No. 3,244,261, but which is characterized by the addition of a container for garment accessories, such as neckties, etc., which are supported within the apparatus in such manner as to prevent wrinkling or improper folding while at the same time being readily attached in position and just as readily detached and removed.

With the foregoing objects and advantages in view, together with still others which will appear as the following description proceeds, the invention resides in the novel construction, combination and arrangement of parts, as will be described more fully hereinafter, illustrated in the drawings, and particularly pointed out in the claims.

Figure 2:
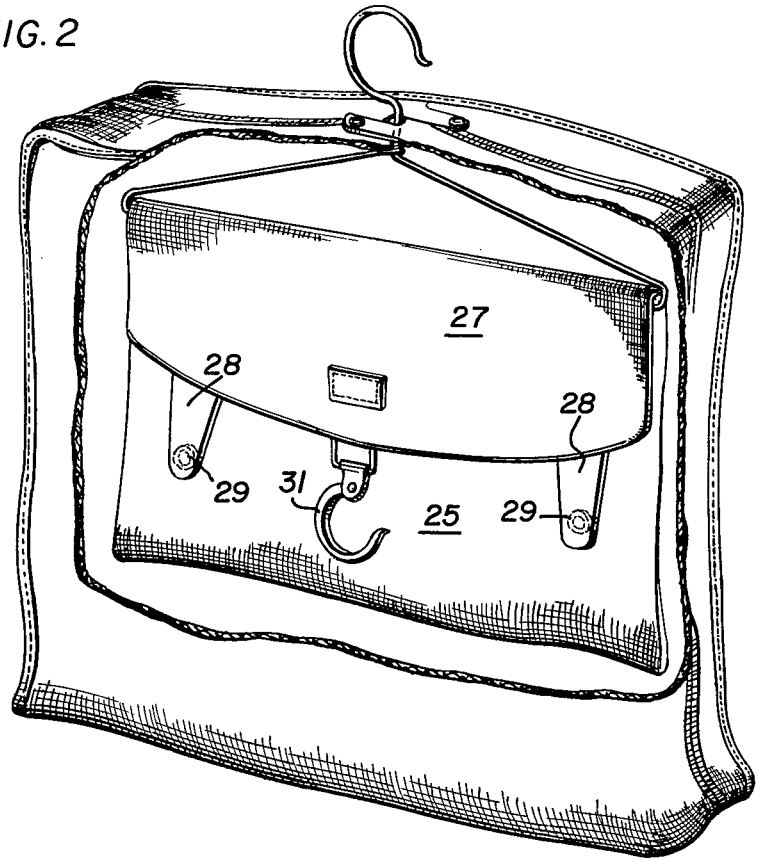
Figure 3:
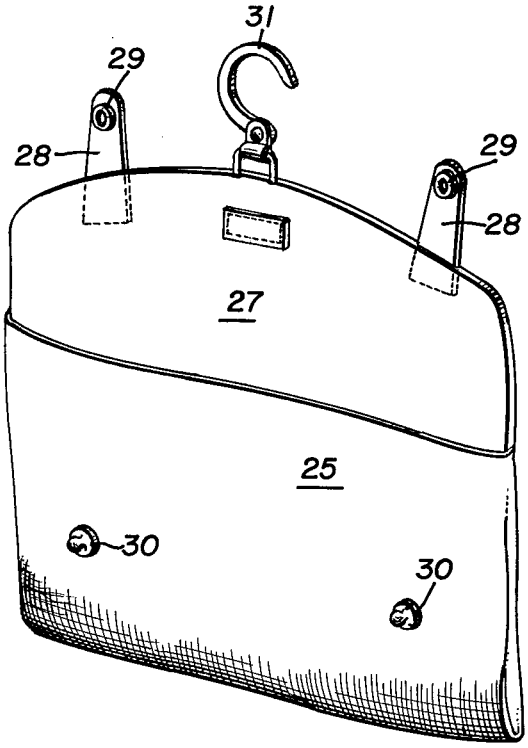

In said drawings:

FIG. 1 is an elevational view of a combined garment cover, hanger and carrier of the type described with the upper and lower portions thereof in extended position, the flaps closed, and with the internally disposed accessories container of the invention represented in phantom lines;

FIG. 2 is an elevational view illustrating the upper and lower portions of the combined garment cover, hanger and carrier in closed position and with portions thereof broken-away to illustrate an improved embodiment of the accessories container as supported by a garment hanger and with the flap in closed position; and FIG. 3 is an elevational view illustrating the accessories container of FIG. 2 as removed from the combined garment cover, hanger and carrier, and with the flap in fully opened position.

Referring more particularly to the drawings, all of the parts of the novel garment cover, hanger, carrier, and accessories container may be formed of any suitable flexible material, such as cloth, rubber, leather, plastic, etc.; and of sufficient length, width and thickness to properly accommodate suits, coats, capes, dresses, and other wearing apparel upon coat or garment hangers whose hooked ends extend through the upper end of the cover in a manner to be later described, to afford means whereby the garment hangers and clothing enveloped by the cover may be suspended from a suitable support in a clothes closet, restaurant, travelling vehicle such as airplane, train, bus, marine vessel, etc.

The garment cover of the apparatus of the invention comprises a substantially rectangular container having a main panel 6 with its lower end shown at 8 and an inverted U-shaped top or upper end 16. The top 16 may be entirely straight or flat but preferably is defined by a pair of substantially straight sections which slope downwardly at each side of the vertical center-line thereof in simulation of the slope of human shoulders. Also shown is a pair of vertically extending overlapping and fastenable flaps 19 and 20 which, together with the aforementioned inverted U-shaped top or upper end 16, form part of my Patent Application Ser. No. 738,314, filed Nov. 3, 1976, abandoned.

When the garment cover, carrier and hanger is in its transversely folded (and carrying) position, the edges of the lower half of the main panel 6 and the free edges of the inverted U-shaped top or upper ends 16 are connected by a zipper fastener 21.

In my U.S. Pat. No. 3,244,261, dated Apr. 5, 1966, there is disclosed an apparatus of the type generally described hereinbefore, but wherein there is a transverse partition member or false bottom along the bottom of the inside of the main garment container which forms a compartment for garment accessories of various kinds, principally shoes, etc.

As earlier indicated, it is among the objects of the present invention to provide, in an apparatus of the type described, an accessories container which is adapted for disposition entirely within the cover or main garment container, but which is adapted for complete and easy removal therefrom. The garment accessories container of the invention is substantially flat and elongated, as shown at 25, and is adapted for connection with, and extension partially or entirely along, the usual horizontally extending hanger bar of one of the coat hangers within the garment cover, hanger and carrier.

This garment accessories container 25 is shown as being just about the same length of the horizontally-extending garment hanger bar of the more or less conventional coat hanger within the cover or main garment container of the apparatus; and has provided along its upper edge a hinged flap 27 which is adapted to overlie the horizontally-extending garment hanger bar of the coat hanger and to be attached to the front of the garment accessories container 25 by fastening means, one form of which is shown as comprising a pair of tabs 28 carrying fastener elements 29 which engage cooperating fastener elements 30 on the front panel of the accessories container.

In addition, the central portion of the outer edge of the flap 27 is provided with a pivotally mounted hook 31 which may be used to hang or suspend the accessories container 25 directly from a horizontally disposed clothes pole (not shown) or other convenient support.

With such an arrangement, as described immediately hereinbefore, the garment accessories container 25 may actually be slightly longer than the horizontally-extending garment hanger bar of the coat hanger; and while it is shown as being rectangular and elongated in the manner of a pouch, it may be of different shape and much deeper construction to receive folded shirts which are not on hangers.

In the rectangular and elongated conformation described herein, and illustrated in the drawings, the garment accessories container 25 is ideal for the reception of neckties, handkerchiefs, scarves, French-cuff buttons, etc.

As earlier indicated, it is among the objects of the present invention to provide, in an apparatus of the type described, a highly efficient accessories container which is adapted for disposition entirely within the main garment container, but which is adapted for complete and easy removal therefrom and separate usage if desired; all of which is achieved in the manner described.

I claim:

1. A garment cover, carrier, hanger and accessories container wherein the garment cover comprises a generally rectangular flexible sheet which is transversely foldable to provide a rear section and a front section; means at the adjacent ends of said rear section and said front section when in folded condition for permitting the extension therebetween of the shank and hook members of a coat hanger while the main body portion of said coat hanger is disposed between said front and rear sections, a zipper fastener for locking together the front and rear sections of said generally rectangular flexible sheet when the same are in transversely folded position; and a pouch-like accessories container including front and rear walls with an extending flap on one of said walls for embracing the horizontal bar of a coat hanger and overlapping the other wall; and means for fastening said flap when in the aforementioned overlapping position.

2. The combination of claim 1 wherein the outer edge of said flap is provided with a hook member which is capable of being supported by a horizontally extending clothes pole or the like.

3. The combination of claim 1 wherein the outer edge of said flap is provided with a pivotally mounted hook member which is capable of being supported by a horizontally extending clothes pole or the like.

* * * * *